US012404728B2

(12) United States Patent
Pai et al.

(10) Patent No.: US 12,404,728 B2
(45) Date of Patent: Sep. 2, 2025

(54) INSULATED COILED TUBING FOR PULSED POWER DRILLING

(71) Applicant: Halliburton Energy Services, Inc., Houston, TX (US)

(72) Inventors: Nagaraja K. Pai, Houston, TX (US); Lucas Samuel Batista Santos, Houston, TX (US); Radovan Rolovic, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/461,068

(22) Filed: Sep. 5, 2023

(65) Prior Publication Data

US 2025/0075569 A1 Mar. 6, 2025

(51) Int. Cl.
*E21B 17/20* (2006.01)
*E21B 7/15* (2006.01)

(52) U.S. Cl.
CPC ..... *E21B 17/206* (2013.01); *E21B 7/15* (2013.01)

(58) Field of Classification Search
CPC ..... F16L 58/02; F16L 58/10; F16L 58/1009; F16L 58/1054; F16L 58/1045; F16L 58/1027; F16L 58/1072; F16L 58/109; E21B 17/003; E21B 17/206; E21B 17/028
See application file for complete search history.

(56) References Cited

U.S. PATENT DOCUMENTS

| | | | | |
|---|---|---|---|---|
| 3,835,929 | A | 9/1974 | Suman | |
| 5,348,097 | A | 9/1994 | Giannesini et al. | |
| 6,015,015 | A * | 1/2000 | Luft | E21B 17/1007 166/57 |
| 7,073,582 | B2 | 7/2006 | Connell | |
| 9,708,867 | B2 | 7/2017 | Lovell et al. | |
| 11,326,399 | B2 | 5/2022 | Gleitman et al. | |
| 11,512,539 | B2 * | 11/2022 | Perez | B21C 37/083 |
| 2002/0112861 | A1 | 8/2002 | Restarick et al. | |

(Continued)

FOREIGN PATENT DOCUMENTS

| | | |
|---|---|---|
| CN | 106014289 | 10/2016 |
| WO | 2013059315 | 4/2013 |
| WO | 2022140719 | 6/2022 |

OTHER PUBLICATIONS

"International Search Report and Written Opinion of the International Searching Authority, International Application No. PCT/US2023/033704", Jun. 4, 2024, 12 pages.

(Continued)

*Primary Examiner* — Kipp C Wallace
(74) *Attorney, Agent, or Firm* — DeLizio, Peacock, Lewin & Guerra LLP

(57) ABSTRACT

Some implementations include a system having at least one thermally insulated coiled tubing and a bottom hole assembly (BHA) connected to the at least one thermally insulated coiled tubing. The BHA includes at least one capacitor, the at least one capacitor configured to store electrical power. The BHA also includes at least one electrode electrically coupled to the at least one capacitor, the at least one electrode configured to receive the stored electrical power from the at least one capacitor and to periodically emit pulsed power discharges into a subsurface formation.

20 Claims, 8 Drawing Sheets

(56) References Cited

U.S. PATENT DOCUMENTS

2003/0213601 A1* 11/2003 Schwendemann .... E21B 17/003 166/387
2005/0199392 A1 9/2005 Connell et al.
2006/0151179 A1 7/2006 Boyadjieff et al.
2008/0277508 A1 11/2008 Moeny
2011/0024103 A1* 2/2011 Storm, Jr. ..... E21B 17/206 166/65.1
2012/0055672 A1 3/2012 Tollefsen et al.
2012/0160361 A1 6/2012 Fischer et al.
2014/0008968 A1 1/2014 Moeny
2015/0162730 A1 6/2015 D'Silva et al.
2015/0184468 A1* 7/2015 Sherman ..... E21B 23/14 166/241.5
2015/0204143 A1 7/2015 Mueller et al.
2016/0273309 A1 9/2016 Maher et al.
2017/0342782 A1* 11/2017 Livescu ..... E21B 36/04
2018/0023731 A1* 1/2018 Varkey ..... F16L 11/127 138/108
2018/0148981 A1* 5/2018 Moeny ..... E21B 17/003
2018/0163478 A1 6/2018 Dirksen et al.
2018/0374607 A1 12/2018 Hernandez Marti et al.
2020/0269276 A1* 8/2020 Perez ..... C23C 24/082
2020/0370375 A1 11/2020 Gleitman et al.
2021/0324683 A1 10/2021 Gleitman et al.
2022/0065090 A1 3/2022 Ejim
2022/0384105 A1 12/2022 Wiecek et al.
2023/0095574 A1 3/2023 Cooley et al.
2023/0102801 A1* 3/2023 Parrella ..... B29C 63/26 138/98
2023/0184043 A1* 6/2023 Hay ..... E21B 17/003 166/65.1

OTHER PUBLICATIONS

"PCT Application No. PCT/US2023/073586, International Search Report and Written Opinion", May 31, 2024, 11 pages.
"EP Application No. 24185757.2 Communication pursuant to Art 94(3) EPC", Nov. 26, 2024, 5 pages.
"U.S. Appl. No. 18/244,729 Non Final Office Action", Sep. 9, 2024, 13 pages.

* cited by examiner

INSULATED COILED TUBING FOR PULSED POWER DRILLING

BACKGROUND

Conventional drilling operations use a traditional drill bit to mechanically drill the wellbore into a subsurface formation. In contrast, electro-crushing drilling uses pulsed power technology to drill the wellbore. Pulsed power technology repeatedly applies a high electric potential across the electrodes of an electro-crushing drill bit, which ultimately causes the surrounding rock to fracture. The fractured rock is carried away from the bit by drilling fluid and the bit advances downhole. Pulsed power drilling, however, requires a significant amount of power. Furthermore, that power may need to be delivered to an electro-crushing drill bit more than a mile away from the drilling platform.

BRIEF DESCRIPTION OF THE DRAWINGS

Implementations of the disclosure may be better understood by referencing the accompanying drawings.

DESCRIPTION OF IMPLEMENTATIONS

Figure 1:
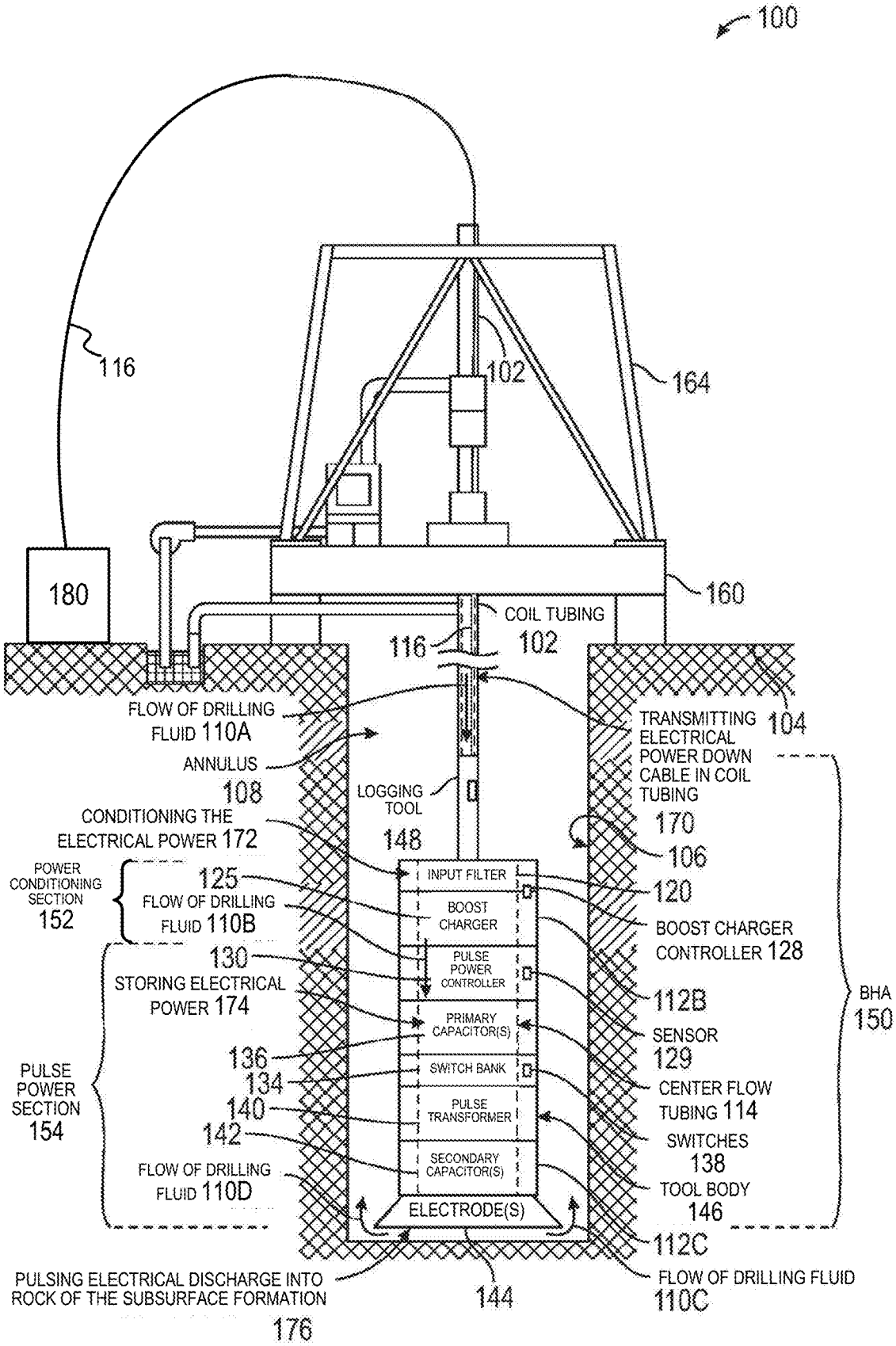
FIG. 1 is a schematic diagram depicting an example coiled tubing pulsed power drilling assembly, according to some implementations.

The description that follows includes example systems, methods, techniques, and program flows that embody implementations of the disclosure. However, it is understood that this disclosure may be practiced without these specific details.

As noted above, the amount of power required at a downhole pulsed power tool for pulsed power drilling is significant. It can be advantageous to deliver such power via a cable integrated in the pathway used to carry drilling fluid to a bottom-hole assembly (BHA). It may be difficult, however, to insert high power cables into conventional drill pipes for delivery of the amount of power needed for pulsed power operations. Hence, in configurations using conventional drill pipes, the power needed to drive a downhole pulsed power tool is generally generated at the BHA from downhole fluid flow under pressure, or drilling is limited to mechanical drilling (i.e., turning a drilling bit to shave away rock).

Downhole power requirements for pulsed power drilling may be exacerbated by the generally poor power conversion efficiencies (<50%) of downhole power generation and power conditioning. For example, total heat loss of up to 250 kilowatts (kW) in the stages leading to the pulsed power tool discharging power (e.g., an electro-crushing drill bit) may lead to difficulties in thermal management. This downhole thermal load is typically cooled by the drilling fluid. In some example approaches, excess energy (heat) at the downhole pulsed power tool is carried away by newly circulated drilling fluid, with the excess heat carried to the surface by the drilling fluid. This cooling becomes, however, less effective if the drilling fluid is already warm when it reaches the downhole pulsed power tool.

Coiled tubing (CT) offers a new way of supplying electrical power to a downhole pulsed power tool. Coiled tubing refers to a continuous length of small-diameter steel pipe (usually ranging from 0.75 to 4.5 inches in diameter) and related surface equipment as well as associated drilling, completion and workover, or remediation, techniques. To deploy tubing downhole, the CT operator spools the tubing off the reel and leads it through a gooseneck, which directs the CT downward to an injector head, where it is straightened just before it enters the borehole. At the end of the operation, the flexible tubing is pulled out of the well and spooled back onto the reel.

Example implementations may include the use of continuous coiled tubing (instead of section drill pipes) for the delivery of the necessary power to perform pulsed power drilling operations. In continuous coiled tubing applications, it may be possible to run continuous power cables and communication cables inside of the coiled tubing. In such configurations, substantial amounts of power may be generated at the surface and transmitted to the BHA via a continuous coiled tubing, which makes high-power pulsed power drilling possible. In one example approach, an electrical cable integrated into the coiled tubing supplies electrical power to a downhole pulsed power tool. In another example approach, an electrical cable is threaded through the coiled tubing and is used to supply electrical power to the downhole pulsed power tool. In some example approaches, thermal insulation is added to the coiled tubing to reduce heat transfer to the drilling fluid as the drilling fluid travels down to the BHA.

In some implementations, a power electronics topology is used to provide the necessary power for pulsed power drilling operations. This power electronics topology may include a multimode-controlled surface power supply and a downhole boost charger for delivering the necessary charge for the pulsed power drilling. Such a system may eliminate a need for a downhole power generator and a complex power conditioning unit to perform pulsed power drilling. Additionally, such implementations may reduce power losses and remove a need for a complex power conversion apparatus.

Thus, example implementations may integrate a power cable with coiled tubing to form a mud flow pipe that may deliver the necessary electrical power to perform the pulsed power drilling. Additionally, example implementations may provide an efficient, impedance matched power delivery to the pulsed power drilling in the BHA. Accordingly, example implementations may enable pulsed power drilling capable of drilling through hard rock subsurface formations. Some such example implementations may achieve a rate of at least 60 feet per hour (ft/h) drilling of a wellbore through hard rock without multiple trips to change the traditional mechanical drill bit. Moreover, example implementations may further include a cable in the coiled tubing used for high-speed communication between the surface and downhole.

Example implementations may include a method to deliver medium or high voltage direct current (DC) power downhole to a boost charger and a power conditioner (which in turn charges a pulsed power unit that is configured for electro-crushing drilling). In some implementations, a single cable or a multi-conductor cable may be integrated in the continuous coiled tubing for delivery of power downhole. In some implementations, at least one of a fiber optic or coaxial communication cable may also be integrated in the continuous coiled tubing. Example implementations may be configured to minimize the conduction losses and total voltage drop when delivering power downhole. In some implementations, while delivering high power downhole, the cables may be properly supported in a fast-flowing drilling fluid medium that is insulated to reduce heating on the path down to the downhole pulsed power tool. The drilling fluid may be highly vicious and under high pressure. In some implementations, the cables may be single or multi-stranded and may be configured to have a low inductance. In some implementations, the amount of power delivered via such cables could be as high as 1000 kilowatts (kW) and the voltage may be as high as 200 kilovolts (kV).

In some implementations, the power delivery system may include a surface component such as a high-voltage power supply. The power delivery system may also include downhole components that are part of the BHA that may include an input filter, a voltage booster, and a smart charger. In some implementations the power delivery system may boost charge a high voltage capacitor (e.g., 16 kV in 2-3 milliseconds) for pulsed power electro-crushing drilling. Such fast-charging capacity may be a necessary feature to achieve a required rate of penetration (ROP) for the drilling of the wellbore.

In some implementations, the power supply at the surface may be an isolated DC power source. The isolated DC power source may have any of a number of different ratings (e.g., 600 kW at a voltage up to 6 kV). In some implementations, the power supply at the surface may deliver the desired power downhole with low ripple, uninterrupted. This power supply may be in continuous communication with a boost charger downhole. In some implementations, a boost charger may be configured to increase the DC power received from the power supply via the power cable at least partially in parallel with storage of the DC power in the at least one capacitor.

Example System

FIG. 1 is a schematic diagram depicting an example coiled tubing pulsed power drilling assembly, according to some implementations. An example pulsed power drilling system 100 may perform or be used to perform example pulsed power drilling (PPD) operations, such as operations 170, 172, 174 and 176. The example pulsed power drilling operations 170, 172, 174 and 176 are described in more detail below (after the description of the different parts of the example pulsed power drilling system 100).

The example pulsed power drilling system 100 may include a drilling platform 160, with a framework 164 positioned to received coiled tubing 102 and to direct the coiled tubing 102 into a wellbore 106. Pulsed power drilling system 100 also includes a pulsed power drilling bottom hole assembly (hereinafter "BHA") 150 positioned in wellbore 106 and coupled to coiled tubing 102. The coiled tubing 102 may comprise one or more coiled tubing strings sourced from one or more coiled tubing reels (not shown). The one or more coiled tubing strings (i.e., coiled tubing from one or more reels) may be coupled together to reach a target depth in the wellbore 106. While depicted on the surface 104 as an onshore drilling operation, example implementations may also be performed as an offshore drilling operation.

The BHA 150 may be configured to further the advancement of the wellbore 106 by pulsing electrical power generated by a power supply 180 at the surface 104 and transmitted to electrodes 144 via an electrical cable 116. The electrodes 144 may be configured to emit an electrical discharge through formation material of a subsurface formation along the bottom face of the wellbore 106 and in the nearby proximity to the electrodes 144. The cable 116 may be capable of supplying power from the power supply 180 at an order of magnitude which provides for the creation of the plasma upon pulse discharges into the formation. The cable 116 may also be capable of transmitting enough power such that an electrical discharge emitted into the formation creates enough internal pressure to destroy the rock in the formation.

As noted above, the power delivered by cable 116 may be used to perform pulsed power drilling. In contrast to conventional wellbore drilling, which uses a drill bit having rotating cutting elements to cause a cutting (fracturing or crushing) of rock, pulsed power drilling extends the wellbore using discharges of electric pulses In some example approaches, the pulses may include short duration, periodic, high-voltage pulses that are discharged through the rock in a surrounding formation. Such discharges may create an internal pressure which applies a tensional stress substantial enough to break or fracture the rock in tension. In some example approaches, pulsed power drilling creates a plasma in the drilling fluid or rock downhole which functions as a high-energy discharge. The creation of the plasma downhole may involve injecting large amounts of energy into the subsurface formation. Thus, pulsed power drilling may require substantial amounts of both voltage and current for successful breakage or fracturing of rock in a downhole environment.

In some implementations, the cable 116 may comprise a single conductor cable or a multiconductor cable. To convey electrical power, the cable 116 may be configured to supply high-voltage DC power to the electrodes 144. In some implementations, a fiber optic cable or a coaxial communication cable may be part of a multiconductor cable configuration to transmit data between the surface 104 and the BHA 150. Alternatively or in addition, a fiber optic cable or a coaxial communication cable may be a separate cable that is conveyed downhole within the coiled tubing 102. Using a cable rather than using other communication mediums (e.g., mud pulse telemetry) may enable high speed communication with equipment at the surface 104. The cable(s) 116 may utilize a single solid cable, a solid multi-cable configuration, or stranded cables that are configured to have a low inductance.

It can be difficult to convey such a cable 116 to depth with a traditional segmented drill pipe. Coiled tubing 102, however, allows for both the cable 116 to be housed within the tubing 102 and may also allow drilling fluid 110 (or mud) to flow from the surface to downhole to provide cooling to the electrodes 144 and to, for example, remove cuttings. In one example approach, each coiled tubing reel may include up to 5,000 ft of coiled tubing, although various sizes of reels may be used, whereas a stand (typically comprising three or four individual joints) of segmented drill pipe may be between 30-55 ft in length. Thus, the segmented drill pipe may require an additional drill pipe to be added for every 30-55 ft of drilling; running a power cable within the drill pipe in this configuration can prove difficult.

In some implementations, the coiled tubing reel(s) configured to store the coiled tubing 102 at the surface 104 have an increased inductance when compared to the cable 116 and BHA 150 in the wellbore 106. This increased inductance may occur because the cable 116 is wound within or otherwise with the coiled tubing 102 in the reel. The inductance of the coiled tubing reel may increase with the number of turns the coiled tubing 102 and cable 116 make around the reel. As more coiled tubing 102 is conveyed into the wellbore 106, the inductance may decrease over time. The difference in inductance at the reel and the cable 116 in the wellbore 106 may induce a voltage overshot and/or ringing from the power supply 180 when transmitting pulsed power to the capacitors 136, 142. An input filter 120, coupled in series with the cable 116 and power supply 180, may be configured to reduce the ringing caused by the inductance discrepancies.

In some implementations, continuous tubing such as the coiled tubing 102 may allow for longer wells to be drilled using a pulse-power drill string. For example, one or more coiled tubings (also referred to as coiled tubing strings) 102 housing the cable 116 may allow the BHA 150 to receive consistent, direct DC power from the power supply 180 via the cable 116. This sustained level of power may enable the BHA 150 to extend the wellbore 106 up to 2-3 miles vertically. The BHA 150 and the electrodes 144, with the benefit of consistent, high voltage DC power, may be capable of extending the wellbore 106 up to 7 miles laterally, which may not be feasible with intermittent power sources used in other pulsed power drilling operations. As further described below, the constant supply of high voltage DC power may be used to power one or more downhole operations in addition to drilling the wellbore 106. For example, DC power output from the power supply 180 may be used to power one or more of the following: nuclear magnetic resonance (NMR) operations, mud pulsing, geosteering equipment, measurement-while drilling (MWD) equipment, etc.

The cable 116 may be configured to reduce conduction losses and total voltage drop as power travels from the power supply 180 to the BHA 150. Compared to more traditional configurations using a downhole power generation device and hydraulic power generation (downhole generator/turbine, alternator, etc.), the cable 116 may be configured to efficiently deliver up to 1,000 kilowatts (kW) of impedance-matched power to the BHA 150 with minimal losses. In some implementations, the cable 116 may deliver 200 kilovolts (kV) to the electrodes 144. In some example approaches, the cable 116 may be mounted or otherwise secured within the coiled tubing 102. In some implementations, the cable 116 may be pre-assembled within the coiled tubing 102. In other implementations, the cable may be mounted or strapped to the outside of the coiled tubing 102. While delivering high power to the electrodes 144, the cable(s) 116 may be properly supported within or against the coiled tubing 102 to withstand a fast-flowing drilling fluid, both for inflow of drilling fluid (110A and 110B) down the coiled tubing 102 and an outflow of drilling fluid (110C and 110D) up the annulus 108. For example, drilling fluid sent down the coiled tubing 102 may be highly viscous and under high pressure. Accordingly, the coiled tubing 102 and cable 116 may form a mud-flow pipe that also delivers electrical power to the BHA 150.

Using the cable 116 to transmit the electrical power to the BHA 150 may also improve the thermal efficiency of the system. For example, a downhole power source, motor, or generator may concentrate heat losses at a single area in the wellbore 106 (within a 75-100 ft interval). Drilling fluid in the area may be heated beyond a desired temperature, and the drilling fluid may require cycling out of the wellbore 106 at a quicker rate. Heat losses from the cable 116, however, may be distributed more evenly in the wellbore 106 (i.e., across the entire length of the cable 116). The distributed heat losses from the cable 116 may regularize thermal management in the wellbore 106 and enable a higher rate of penetration (ROP) of the BHA 150. Lower heat losses may enable the pulse power section 154 to operate more efficiently, which may enable the electrodes 144 to arc into the formation (thus, drilling the formation) at an increased rate. In addition to minimizing heat losses, the pulsed power drilling system 100 may also be configured to minimize power losses. Utilizing the cable 116 eliminates the need for a complex power conversion apparatus. The power topology comprising the power supply 180, the cable 116, and the boost charger 125 may reduce power losses during the delivery of a required charge to the electrodes 144 when compared to more traditional PPD systems. Thermally insulating coiled tubing 102, as discussed below, further increases cooling efficiency.

Figure 2:
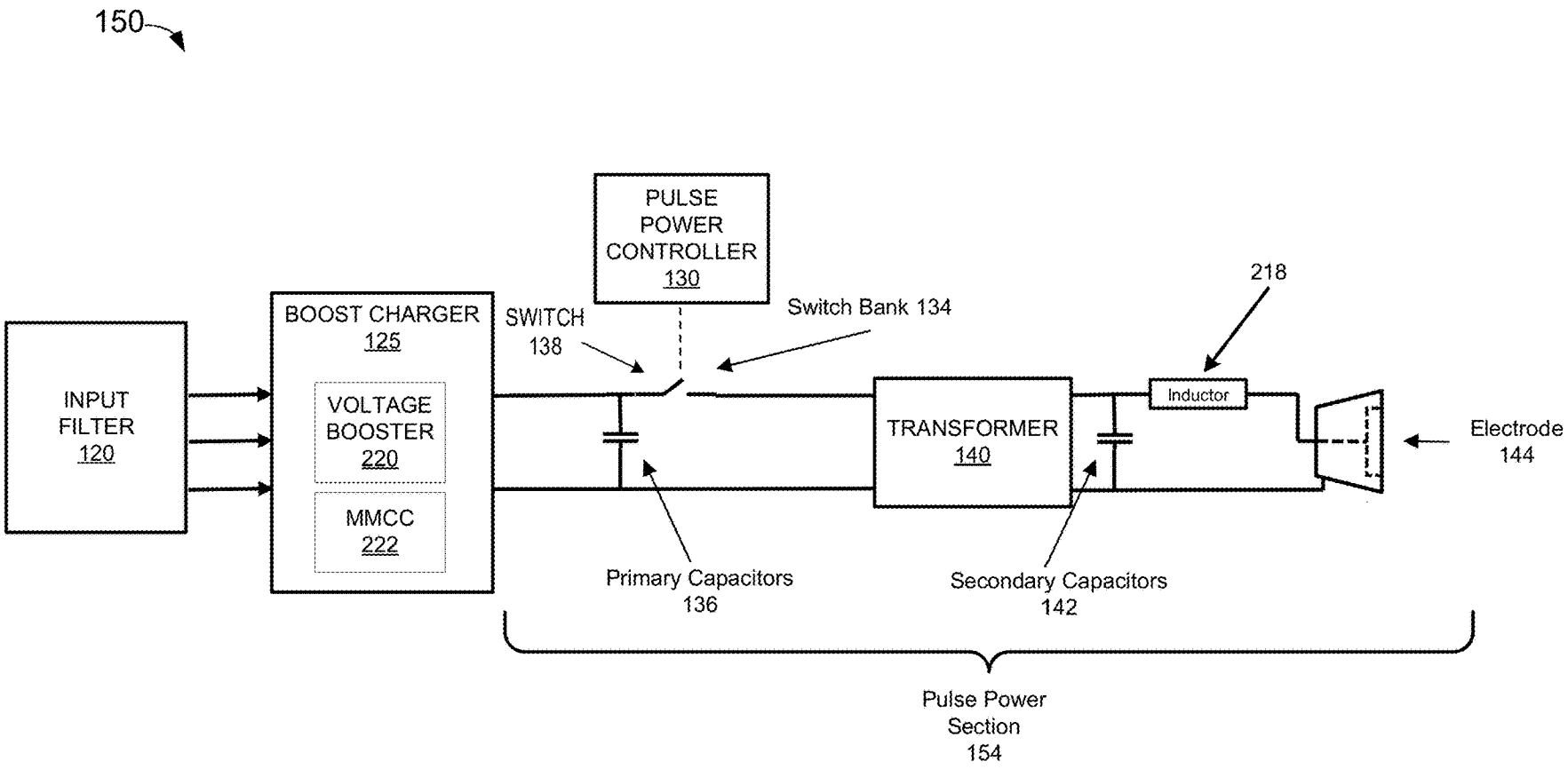
FIG. 2 is an illustration depicting an example electrical configuration for storing of electrical power for the pulse power section of the pulsed power drilling assembly of FIG. 1, according to some implementations.

As illustrated in FIG. 1, the BHA 150 includes multiple sub-assemblies, including, in some implementations, an input filter 120 at a top of the BHA 150. The top of the assembly is a face of the BHA 150 furthest from a drilling face of the BHA 150 (which contains the electrodes 144). The input filter 120 is coupled to multiple additional subsections or components. The input filter 120 may be configured to reduce ripples in current and/or voltage output from the power supply 180 and along the cable 116. A boost charger 125 (comprising a voltage booster 220 or similar power converter and a multi-mode capacitor charger (MMCC) 222, as shown in FIG. 2) positioned below the input filter 120 may be configured to receive the filtered electrical power output from the input filter 120. In some implementations, the multi-mode capacitor charger 222 may be a smart charger capable of fast charging. For example, the multi-mode capacitor charger may be configured to switch between a constant current mode and constant power mode to optimize charging of the primary capacitor(s) 136 depending upon which modes charge the capacitors 136, 142 fastest. The BHA 150 may additionally comprise a pulse power controller 130, a switch bank 134 (including one or more switches 138), one or more primary capacitor(s) 136, a pulse transformer 140 with one or more primary and secondary windings, one or more secondary capacitors 142, and the electrodes 144. In some implementations, the power supply 180 (at the surface 104), the cable 116, input filter 120, and boost charger 125 (located in the wellbore 106) may be referred to as a power delivery system.

DC power output from the power supply 180 may be stored in the capacitors 136, 142 prior to a discharge criteria being satisfied. For example, a discharge or load criteria may be that a defined amount of energy has been stored. As an example, this criteria may be satisfied when the primary capacitor(s) 136 is fully charged. In another example, this criteria may be satisfied when the amount of energy that has been stored is sufficient to break the rock in the current subsurface formation. Accordingly, the amount of energy needed may vary depending on the type of rock. In another example, the criteria may be that a bottom of the pulse power drill string is in contact with a bottom of the wellbore 106. This may include any contact or some defined amount of surface area of the bottom of the pulse power drill string being in contact. In another example, the discharge criteria may be a defined amount of time since a prior electrical discharge.

In some implementations, the power may continue to be supplied by the cable 116 after the primary capacitor(s) 136 is fully charged. After the amount of energy stored in the primary capacitor(s) 136 exceeds a defined amount (e.g., fully charged), a switch within switch bank 134 may be opened to prevent additional storage of energy in the primary capacitor(s) 136 until the energy is discharged therefrom to generate a pulse of electrical discharge emitted into the subsurface formation. The switch may then be closed to again allow for storage of energy in the primary capacitor(s) 136.

The BHA 150 may be divided into a power conditioning section (PCS) 152 and a pulse power section 154. The PCS 152 may include the input filter 120 and the boost charger 125. The power supply 180 may be configured to deliver medium voltage or high voltage DC power to the boost charger 125 in PCS 152, which in turn sends power to charge one or more capacitors (136, 142) of the pulse power section 154. The pulse power section 154 may include the pulse power controller 130, the switch bank 134 (and switch(es) 138), the one or more primary capacitor(s) 136, the pulsed transformer 140, the one or more secondary capacitors 142, and the electrodes 144. Components may be divided between the power conditioning section 152 and the pulse power section 154 in other arrangements, and the order of the components may be other than shown.

While a single boost charger 125 is depicted in FIG. 1, two or more boost chargers may be used along different locations along the coiled tubing 102 to boost the voltage of received power and to charge the capacitors 136, 142. For example, a boost charger 125 may be installed at one or more locations in the coiled tubing 102. In some implementations, as multiple reels of coiled tubing are conveyed into the wellbore 106, couplings between each coiled tubing string may comprise a boost charger 125. Each of the boost chargers along the coiled tubing 102 (or string of coiled tubings) may be configured to increase the voltage stepwise until reaching the capacitors 136, 142 where a final boost charger proximate to the BHA 150 may be used to charge the capacitors 136, 142.

In some implementations, DC electrical power may be conditioned by one or more input filters before storage in primary capacitor(s) 136 in the BHA 150 (as stored energy). For example, PCS 152 may be configured to condition electrical power prior to use within and eventual discharge from the pulse power section 154. The input filter 120 may be configured to receive electric power from the cable 116 and output conditioned electrical power. The conditioning may comprise filtering, by the input filter 120, out ripples in current and voltage from the DC power received from the power supply 180. While the DC power is continuous, the loading of the boost charger 125 may be slightly pulsed rather than exhibiting continuous power draw. The input filter 120 may flatten any ripple in the received DC power prior to being used in the pulse power section 154. Further processing of the electrical power output received at the PCS 152 may include voltage boosting, and frequency and/or waveform smoothing or regulating of the received electrical power.

In some implementations, the secondary capacitor(s) 142 may be configured with a higher or current rating than the primary capacitor(s) 136. In this configuration, the power supply 180 may be configured with a higher voltage rating (>6 kV) and may be coupled to the input filter 120 and boost charger 125. From the boost charger 125, the higher voltage power may be routed to the secondary capacitor(s) 142 and output from the electrode(s) 144. While FIG. 1 depicts the PCS 152 positioned in the wellbore 106 as part of the BHA 150, some implementations may position the input filter 120 and boost charger 125 at the surface 104.

A center flow tubing 114 may be coupled to an end of the coiled tubing 102 and may travel through the BHA 150, acting as a conveyance tubing. In some implementations, the center flow tubing 114 may be a shorter section of coiled tubing configured to extend through both PCS 152 and pulse power section 154. A flow of drilling fluid 110A (illustrated by the arrow pointing downward within the coiled tubing 102) may be provided from the drilling platform 160, and flow to and through the power conditioning section 152 and pulse power section 154 of the BHA 150, as indicated by the arrow for the location and direction of flow of drilling fluid 110B. The PCS 152 may further process and controllably provide the electrical power to the rest of the downstream BHA 150. The stored power may then be output from the electrodes 144 to perform the advancement of the wellbore 106 via periodic electrical discharges. In some implementations, pulsed power drilling (achieved by the periodic electrical discharges) may be capable of advancing the wellbore by 60 to 150 feet per hour through one or more hard rock (i.e., consolidated) subsurface formations. By using the coiled tubing 102, the pulsed power drilling may avoid issues with forming connections between joints of segmented drill pipe. The use of the coiled tubing 102 and electrodes 144 for pulsed power drilling may also eliminate the need for multiple trips to change the drill bit.

In some implementations, the drilling fluid used in the wellbore 106 may include a dielectric drilling fluid. The dielectric drilling fluid may be a mixture of drilling mud and one or more dielectric sands which may grant the drilling fluid dielectric properties. While the dielectric sands may increase the viscosity of the drilling fluid, their dielectric properties may ensure that electrical discharges emitted from the electrodes 144 do not propagate up the wellbore 106 or to the surface 104.

The drilling fluid may flow through the BHA 150, as indicated by drilling fluid 110B, and flow out and away from the electrodes 144 and back toward the surface to aid in the removal of the debris generated by the breaking up of the formation material at and nearby the electrodes 144. The fluid flow direction away from the electrodes 144 is indicated by the arrows indicating the location and direction of flow of drilling fluids 110C and 110D. In addition, the flow of the drilling fluid 110 may provide cooling to one or more devices and to one or more portions of the BHA 150. In various implementations, it is not necessary for the BHA 150 to be rotated as part of the drilling process, but some degree of rotation or oscillations of the BHA 150 may be provided in various implementations of drilling processes utilizing the BHA 150.

The flow of drilling fluid 110 passing through the BHA 150 may continue to flow through the center flow tubing 114, which thereby provides a flow path for the drilling fluid 110 through one or more sub-sections or components of the PCS 152 and PPS 154, as indicated by the arrow 110B pointing downward through the cavity of the sections of the center flow tubing 114. Once arriving at the electrodes 144, the flow of drilling fluid may be expelled out from one or more ports or nozzles located in or in proximity to the electrodes 144. After being expelled from the BHA 150, the drilling fluid may flow back upward toward the surface through an annulus 108 created between the BHA 150 and walls of the wellbore 106.

The center flow tubing 114 may be located along a central longitudinal axis of the BHA 150 and may have an overall outside diameter or outer shaped surface that is smaller in cross-section than the inside surface of a tool body 146 in cross-section. As such, one or more spaces may be created between the center flow tubing 114 and an inside wall of the tool body 146. These one or more spaces may be used to house various components, such as components which make up the input filter 120, the boost charger 125, the boost charger controller 128, a sensor 129, the pulse power controller 130, the switch bank 134, the one or more switches 138, the one or more primary capacitor(s) 136, the pulsed transformer 140, and the one or more secondary capacitors 142, as shown in FIG. 1. The sensor 129 may be in different locations within the BHA 150. As depicted in FIG. 1, the sensor 129 is positioned near the pulse power controller 130. However, the sensor 129 may be in any location within the BHA 150 and may include more than a single sensor (depending on the size and sensor measurement). Other components may be included in the spaces created between the center flow tubing 114 and the inside wall of the tool body 146. In some examples, a section 112B of tool body 146 and a section 112C of tool body 146 are used for PCS 152 and pulse power section 154, respectively. In one such example, sections 112B and 112C may be constructed to allow PCS 152 to be separated from pulse power section 154 when needed without removing tool body 146.

The example pulsed power drilling system 100 may include one or more logging tools 148. The logging tool(s) 148 are shown as being coupled to the coiled tubing 102 within the BHA 150. In some implementations, the logging tool 148 may be located above the BHA 150 or may be joined via a shop joint or field joint to BHA 150. The logging tool(s) 148 may include one or more logging while drilling (LWD) or measurement while drilling (MWD) tools, including, for example, a resistivity tool, a gamma-ray tool, and nuclear magnetic resonance (NMR) tool. The logging tools 148 may include one or more sensors to collect data downhole. For example, the logging tools 148 may include, for example, pressure sensors and flowmeters. The example pulsed power drilling system 100 may also include directional control, such as for geosteering or directional drilling, which may be part of the BHA 150, the logging tool(s) 148, or located elsewhere on the coiled tubing 102.

Communication from the pulse power controller 130 to the boost charger controller 128 allows the pulse power controller 130 to transmit data about and modifications for pulsed power drilling to the power conditioning section 152. Similarly, communications from the boost charger controller 128 to the pulse power controller 130 may allow the power conditioning section 152 to transmit data about and modifications for pulsed power drilling to the pulse power section 154. The pulse power controller 130 may control the discharge of the pulsed power stored for emissions out from the electrodes 144 and into the formation, into drilling mud, or into a combination of formation and drilling fluids. The pulse power controller 130 may measure data about the electrical characteristics of each of the electrical discharges-such as power, current, and voltage emitted by the electrodes 144. Based on information measured for each discharge, the pulse power controller 130 may determine information about drilling and about the electrodes 144, including whether the electrodes 144 are firing into the formation (i.e., drilling) or firing into the formation fluid (i.e., electrodes 144 are off bottom). The power conditioning section 152 may control the charge rate and charge voltage for each of the multiple pulsed power electrical discharges. The PCS 152, with electrical power supplied via the cable 116 may create an electrical charge in the range of 10-20 kilovolts (kV), which the pulse power controller 130 delivers to the formation via the electrodes 144.

In some example approaches, the pulse power controller 130 may communicate with the power conditioning section 152, enabling the power conditioning section 152, for instance, to ramp up and ramp down in response to changes or electrical discharge characteristics detected at the pulse power controller 130. Because the load on the power conditioning section 152 is large (due to the high voltage), ramping up and ramping down in response to the needs of the pulse power controller 130 may protect the power conditioning section 152 and associated components from load stress and may extend the lifetime of components of the pulsed power drilling assembly. If the pulse power controller 130 is unable to communicate with the power conditioning section 152, then the power conditioning section 152 may apply a constant charge rate and charge voltage to the electrodes 144.

In instances where the BHA 150 is off bottom, electrical power input to the system may be absorbed (at least partially) by drilling fluid, which may be vaporized, boiled off, or destroyed because of the large power load transmitted in the electrical pulses. In instances where the BHA 150 is not operating correctly, such as when one or more switch experiences a fault or requires a reset, application of high power to the primary and/or secondary capacitors 136/142 or the electrodes 144 may damage circuitry and switches when applied at unexpected or incorrect times. In these and additional cases, communication between the pulse power controller 130 and the power conditioning section 152 may allow the entire BHA 150 to, for instance, vary charge rates and voltages. In cases where the pulse power controller 130 and power conditioning section 152 are autonomous, i.e., not readily in communication with the surface, downhole control of the BHA 150 may improve pulsed power drilling function.

Pulsed power drilling operations may include various operations. For example, such an operation may include pulsing of an electrical discharge to breaking off rock to continue to drill the wellbore 106 (e.g., electro-crushing). Another example operation may include pulsing of an electrical discharge while the drill string is off bottom for testing or formation evaluation. Another example operation may include pulsing of an electrical discharge for communication.

A series of example pulsed power drilling operations 170-176 within pulsed power drilling system 100 are now described. A first operation 170 includes transmitting electrical power generated from the power supply 180 down the cable 116 within the coiled tubing 102. The cable 116 may be mounted within the coiled tubing 102 to accommodate a flow of drilling fluid 110A during a pulsed power drilling operation. A second operation 172 includes conditioning the electrical power. For example, the input filter 120 may smooth the electrical power input from the cable 116, and the boost charger 125 may increase a voltage of the electrical power. Conditioning of the electrical power that may be may also include altering or controlling one or more electrical parameters associated with the received electrical power including, but not limited to voltage, current, phase, and frequency.

A third operation 174 includes storing the conditioned electrical power. To help illustrate, FIG. 2 is an illustration depicting an example electrical configuration for storing of electrical power for the pulse power section of the pulsed power drilling system of FIG. 1, according to some implementations. The electrical power may be stored in a primary capacitor 136 ("primary capacitor") of the pulse power section 154. The input filter 120 is configured to output conditioned DC electrical power received from the cable 116 to the boost charger 125. The electrical power may be stored in the primary capacitor(s) 136 while switch(es) in the switch bank 134 are open. For simplicity, FIG. 2 depicts only one switch 138 in the switch bank 134. However, example implementations may include other switches and configurations.

As further described below, a pulsed electrical discharge may be periodically output from the electrode(s) 144 to perform pulsed power drilling. A switch 138 of the switch bank 134 may remain open until a sufficient amount of power has been stored in the primary capacitors 136. After a sufficient amount of power has been stored in the primary capacitors 136, the switch 138 may be closed to supply power to the pulsed transformer 140 and the secondary capacitors 142 (through an inductor 218), which is then emitted from the electrode(s) 144 as a pulse of electrical discharge into the subsurface formation for pulsed power drilling. For example, another switch 138 may be closed when the primary capacitor(s) 136 storing the energy are fully charged. Alternative or additional criteria may be used to determine when to close the switch(es) 138, as further described below.

A fourth operation 176 includes pulsing an electrical discharge into the rock of the subsurface formation. For example, the pulse power controller 130 may determine whether at least one discharge criteria has been satisfied. The discharge criteria may be a criteria that a defined amount of energy has been stored in the primary capacitor(s) 136. For example, the discharge criteria may be that the primary capacitor(s) 136 are fully charged, charged more than a defined percentage of the full storage capacity (e.g., 99%, 95%, 90%, 50%, etc.), etc.

Another example criteria may be that a bottom of the drill string is in contact with a bottom of the wellbore. For example, the criteria may be that at least a minimum amount of surface area of the bottom of the drill string in contact with a bottom of the wellbore 106. Another example criteria may be that a defined amount of time has elapsed since a prior pulsing of the electrical discharge. This defined amount of time may help ensure that the bottom of the drill string is in contact with a bottom of the wellbore prior to pulsing of the electrical discharge. In response to the discharge criteria being satisfied, the pulse power controller 130 may cause the primary capacitor(s) 136 to release the stored energy from the primary capacitor(s) 136 through the electrode(s) 144—resulting in a pulse of electrical discharge into the surrounding subsurface formation. This pulsing of the electrical discharge may continue to occur periodically in response to the discharge criteria being satisfied.

In some example approaches, the power delivery system of the pulsed power drilling system 100 may include the power supply 180, input filter 120, and boost charger 125. In one example approach, power supply 180 includes a 3 kV to 6 kV isolated DC power supply placed proximate to drilling platform 160. The DC power supply may have a typical power rating of 600 kW and a voltage rating up to 6 kV and may be configured to deliver desired, uninterrupted, low-ripple power along cable 116. The cable 116 may be housed in coiled tubing 102 as discussed above. The DC power supply may be in continuous communication with the boost charger 125, which includes both a voltage booster 220 and a multi-mode capacitor charger (MMCC) 222. Some implementations of the DC power supply may be capable of outputting higher voltages (>6 kV). In some such configurations, the cable 116 may be configured with a smaller conductor diameter (with lower conduction loss along the cable 116) and an increased surface area of an exterior insulation.

As shown in FIG. 1, the boost charger 125 may be coupled to a power supply 180, which in some example approaches is the DC power supply described above. In some example approaches, the boost charger module 125 may include voltage booster 220 and multi-mode capacitor charger 222 (also referred to as a smart charger) described above. The voltage booster 220 may receive the output filtered electrical power from the input filter 120 at a first voltage and output a boosted electrical power at a second voltage that is greater than the voltage of the filtered electrical power received as an input. In some implementations, the voltage booster 220 may receive an input power having a voltage between 3-6 kV and may deliver power up to 500-800 kW. These numbers may not be substantial to emit an arc from the electrodes 144 to fracture formation rock, so the voltage booster may boost an input voltage up to 16 kV.

The boosted voltage output from the voltage booster may be input to multi-mode capacitor charger 222. The multi-mode capacitor charger 222 may, in some example approaches, be configured to charge the primary capacitor(s) 136 and secondary capacitor(s) 142 at a constant (i.e., not pulsed) rate. A charge rate of the capacitors 136, 142 may be augmented depending on a desired rate of penetration to be achieved by the electrodes 144. To achieve a higher ROP, more pulses per second may be required. A drilling operation may initiate with a lower pulsed rate of, for example, 10 pulses per second that are emitted into a subsurface formation. Over time, the pulsed rate may increase to a rate of up to, for example, 300 pulses per second. At this rate, the multi-mode capacitor charger 306 may only have 3.3 milliseconds (ms) to charge the capacitors prior to emission from the electrodes 144. Modulating the rate of charging of the capacitors and a desired number of pulses to emit may be controlled via the boost charger controller 128 of FIG. 1.

In some implementations and as previously discussed, the multi-mode capacitor charger 222 may be configured as a smart charger capable of switching between constant current and constant power modes to avoid overloading the power delivery system. In some implementations, other electric load modes may be possible. For example, the multi-mode capacitor charger 222 may begin with a constant current mode during charging of the capacitors 136 and 142 and switch to a constant power mode when a power delivery limit of power supply 180 has been reached. Sustaining the constant power mode may cause the current to reduce over time, and the multi-mode capacitor may choose to remain in the constant power mode or switch back to the constant current mode based on various system parameters. For example, a multi-mode capacitor charger 222 may be configured to analyze load properties of the power supply 180 and of capacitors 136 and 142. In one example approach, a multi-mode capacitor charger 222 may be configured to avoid overloading the power supply 180 and to avoid choking the capacitors 136 and 142 of power by modulating between the various electrical modes to optimize the use of components within the system 100.

In some example approaches, the voltage booster 220 and the multi-mode capacitor charger 222 may work in tandem within the boost charger 125 to boost charge a high voltage pulsed capacitor, such as the primary capacitor (in the pulsed power tool) 136, to approximately 15 kV within 5 to 10 milliseconds (ms). In other example approaches, the boost charger 125 may be configured to charge the primary capacitor 136 in less than 5 ms or in greater than 10 ms, if desired. Fast voltage boosting and fast charging may be needed to achieve required rates of penetration (ROP) while pulsed power drilling with an electro-crushing drill bit. In some example approaches, the voltage booster 220 and the multi-mode capacitor charger 222 are contained within the boost charger 125 as shown in FIG. 2. However, in some implementations, the voltage booster 220 and multi-mode capacitor charger 22 may be separate, distinct components that are used to boost the voltage of received power and to charge the primary capacitor 136, respectively. A switch in switch bank 134 may be configured to close to permit charging of the primary capacitor 136. The switch may also be configured to open to prohibit charging of the primary capacitor 310.

Figure 3:
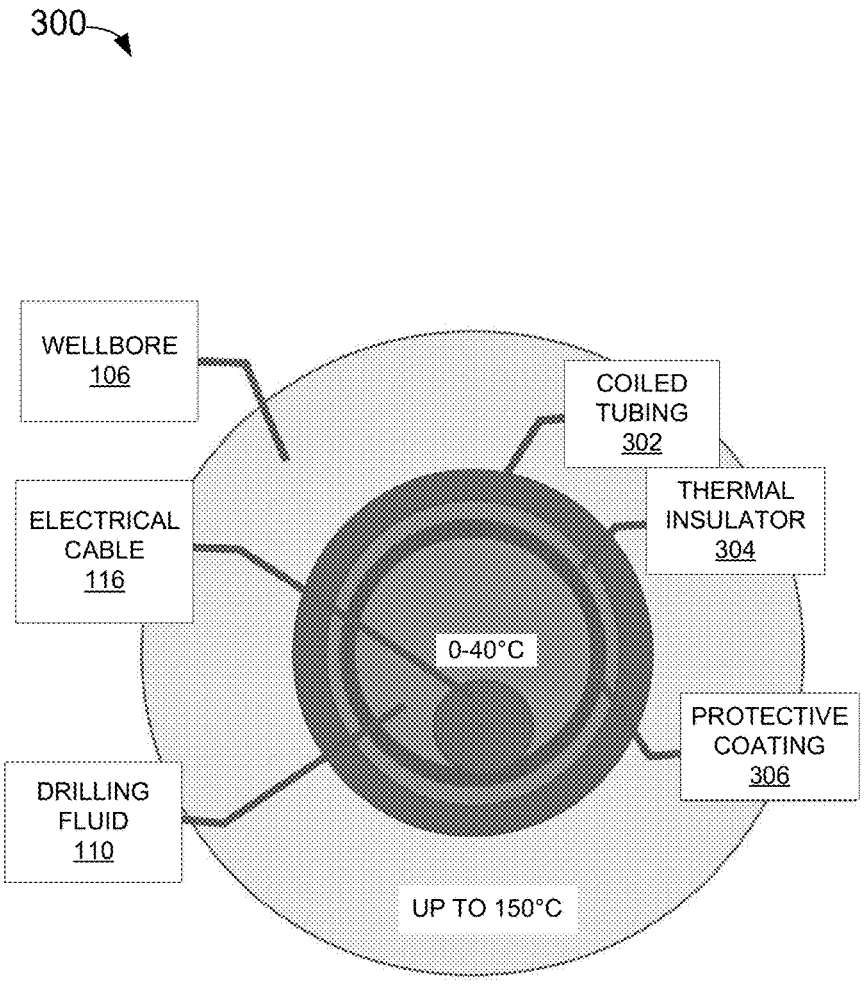
FIG. 3 is a top-side view of a cross-section of an example insulated coiled tubing installed in a pulsed power drilling system, according to some implementations.

FIG. 3 is a top-side view of a cross-section of an example insulated coiled tubing installed in a pulsed power drilling system 300, according to some implementations. In the example insulated coiled tubing 302 of FIG. 3, a thermal insulator 304 is installed on the interior side of coiled tubing 302. In the example shown in FIG. 3, the thermal insulation 304 is selected to limit heating of drilling fluid 110 flowing down to the BHA by the drilling fluid 110 returning to the drilling platform 160. In some example approaches, a protective coating 306 is placed over thermal insulator 304 to protect the insulation from damage by debris in the drilling fluid 110.

Figure 4:
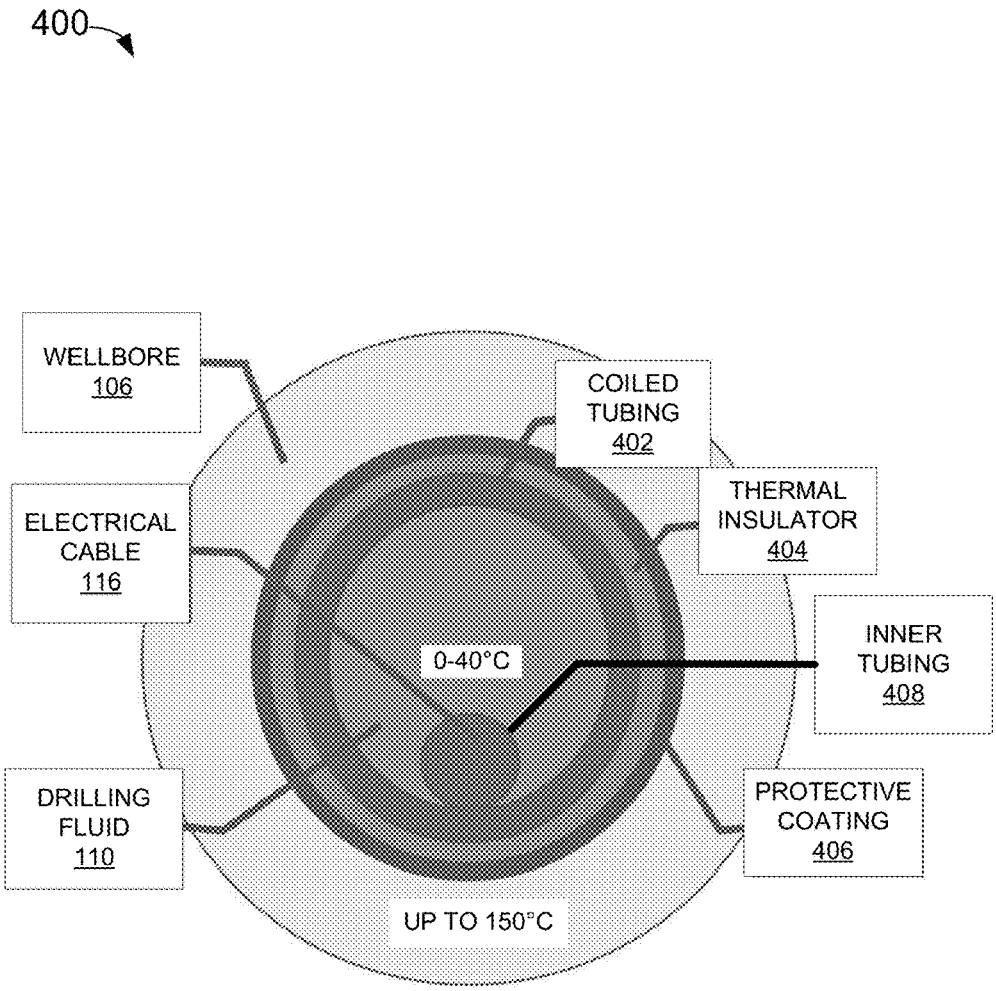
FIG. 4 is a top-side view of a cross-section of another example insulated coiled tubing installed in a pulsed power drilling system, according to some implementations.

FIG. 4 is a top-side view of a cross-section of another example insulated coiled tubing installed in a pulsed power drilling system 400, according to some implementations. In the example insulated coiled tubing 402 of FIG. 4, a thermal insulator 404 is installed on the exterior side of coiled tubing 402. In the example shown in FIG. 4, the thermal insulation 404 is selected to limit heating of drilling fluid 110 flowing down to the BHA by the drilling fluid 110 returning to the drilling platform 160. In some example approaches, a protective coating 406 is placed over thermal insulator 404 to protect the insulation from damage by debris in the drilling fluid 110 returning to drilling platform 160.

Figure 5:
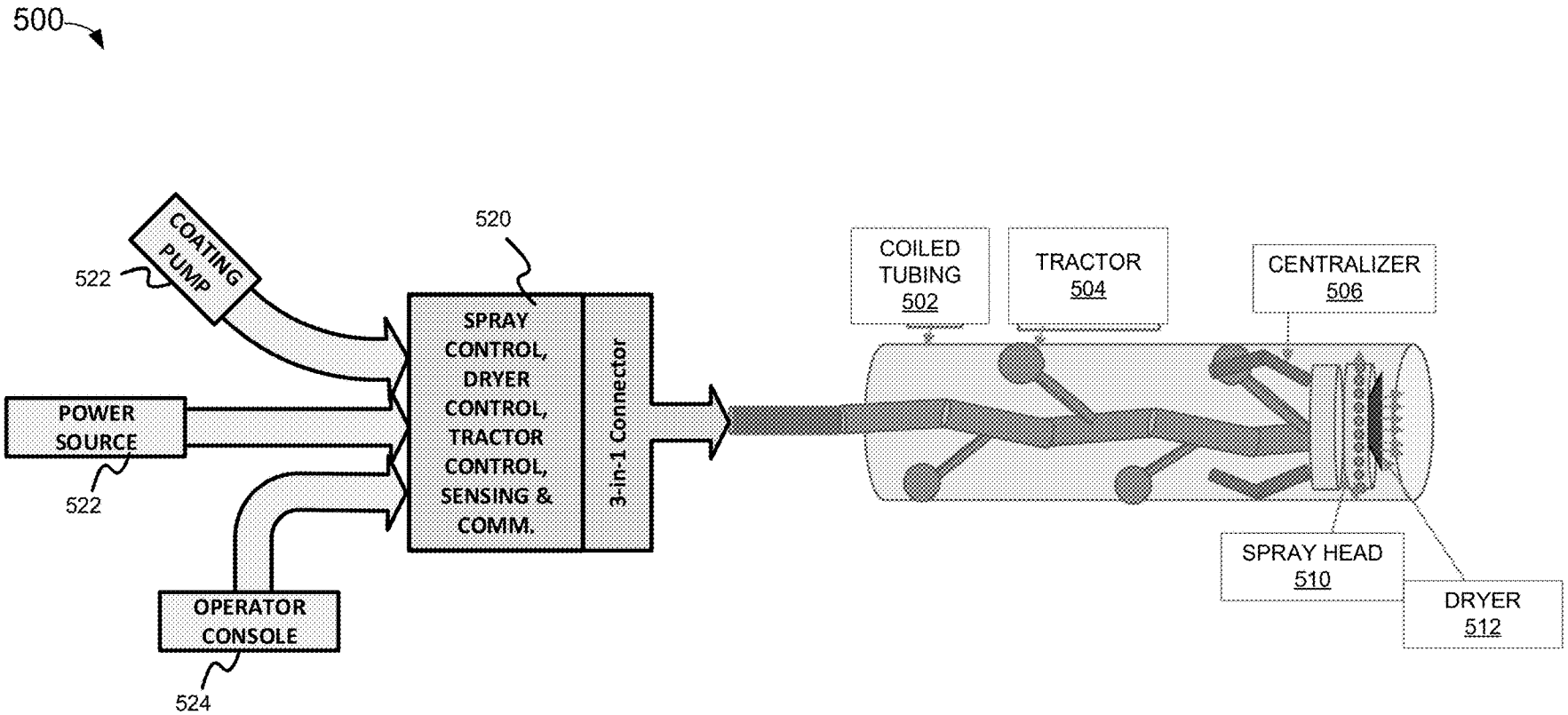
FIG. 5 is an illustration of a technique for applying insulation on an inner surface of coiled tubing, according to some implementations.

FIG. 5 is an illustration of a technique for applying insulation on an inner surface of coiled tubing, according to some implementations. In the example technique of FIG. 5, a tractor 504 is used to apply insulation to an interior surface of coiled tubing 502. Tractor 504 includes a centralizer 506 and a spray head 510. In some examples, tractor 504 further includes a dryer 512 used to dry the insulation as the tractor 504 moves through CT 502.

In the example approach shown in FIG. 5, a 3-in-1 connector module 520 connects tractor 504 to coating pump 522, power source 522 and operator console 524. Power source 522 supplies power to the tractor 504, the spray head 510 and, if present, to dryer 512. The operator console 524 provides an interface for user control of the tractor 504, the spray head 510 and, if present, to dryer 512. In some example approaches, connector 520 also provides sensing and communication with the tractor 504 and its components downhole.

In one example approach, coating pump 522 pumps an emulsion fluid such as NANSULATE™ Protective Thermal Insulation and Corrosion Preventive Coating manufactured by Syneffex of Naples, Florida to spray head 510, where the fluid is sprayed on the inside surface of coiled tubing 502. Other sprayable insulation products may be used as well.

Other methods may be used to apply the thermal insulation to coiled tubing 102. In one example approach, the tubing is laid flat and insulation is applied before the material is rolled and sealed into a tube. In another example approach, a stationary spray head is used to insulate a moving CT. In another example approach, a magnetically centralized spray head sprays the inside of the coiled tubing. In yet another example approach, a limited travel spray-head shuttles back and forth with reel-to-reel transfer of CT. In yet another example approach, two tractors are used, with one applying the insulation and the second drying the insulation. In yet another example approach, a plasma deposition system is integrated into the CT manufacturing equipment so that a suitable insulating material can be deposited during CT fabrication. This may be done before or after tube welding.

Figure 6:
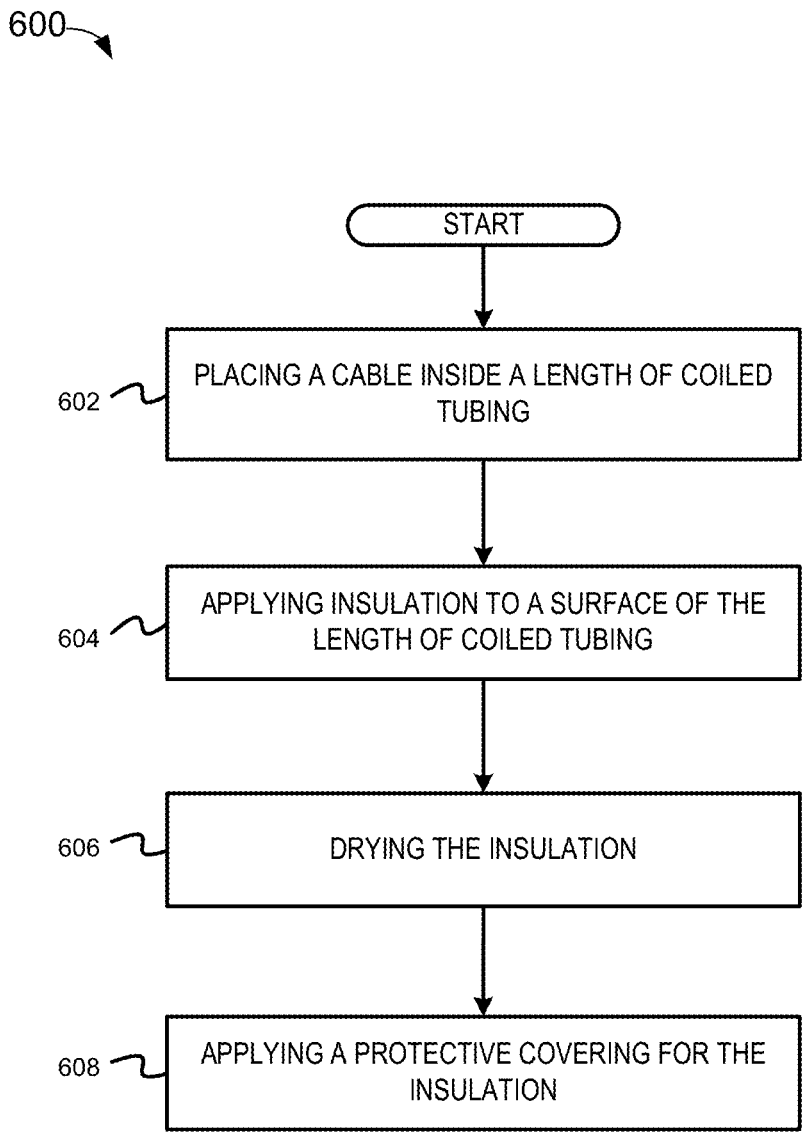
FIG. 6 is a flowchart illustrating a technique for applying insulation on a surface of coiled tubing, according to some implementations.

FIG. 6 is flowchart illustrating of a technique 600 for applying insulation on a surface of coiled tubing, according to some implementations. In the example shown in FIG. 6, a cable is placed (602) inside a length of coiled tubing, running approximately the length of the coiled tubing. Insulation is applied (604) to a surface of the length of coiled tubing and the insulation is dried (606). The insulation may be applied by a tractor as described in the context of FIG. 5. A protective coating may then be applied (608) to the insulation.

Example Operations

Figure 7:
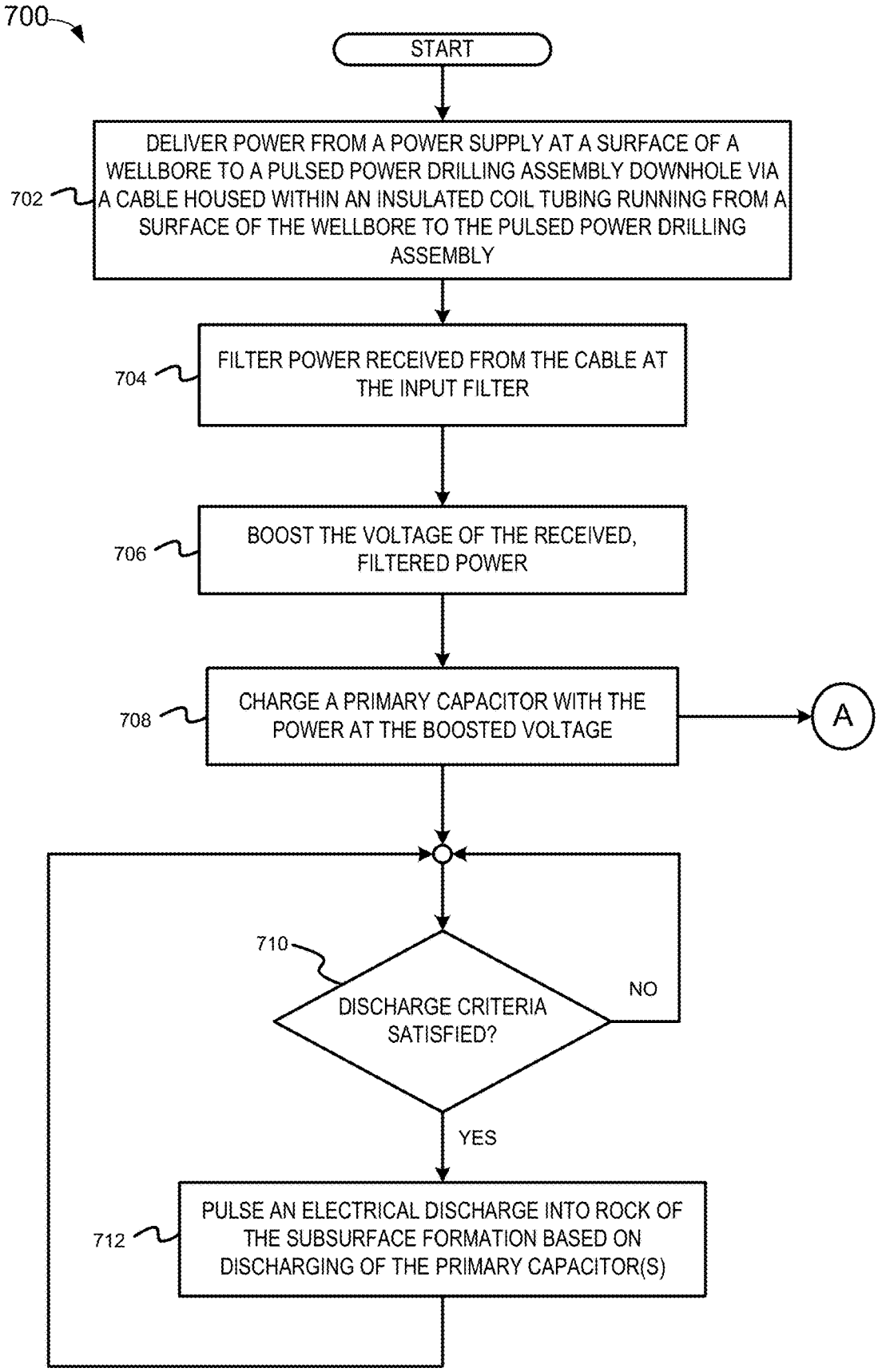
FIGS. 7 and 8 are flowcharts depicting example operations for pulsed power drilling, according to some implementations.
Figure 8:
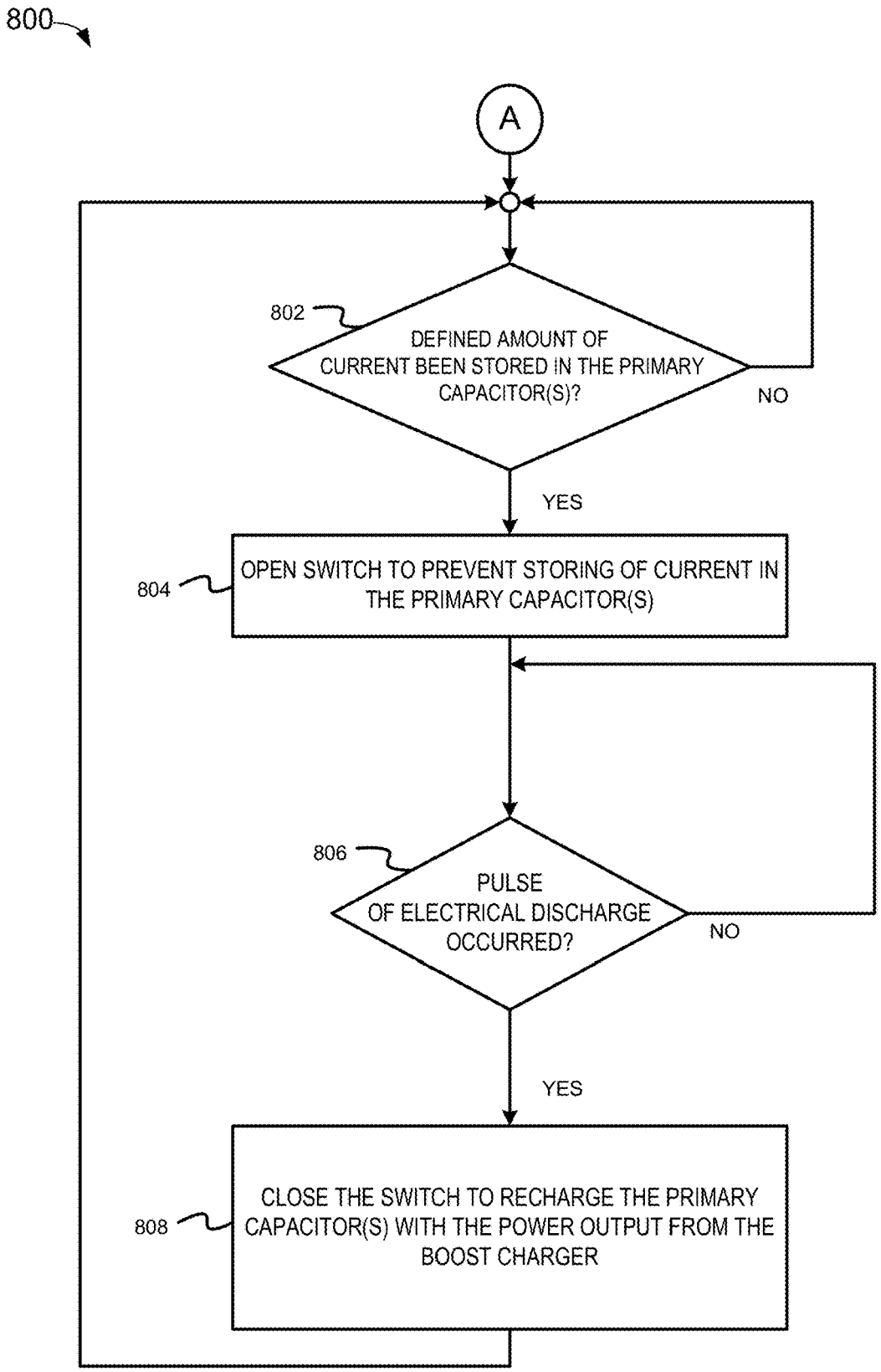

Example operations for pulsed power drilling are now described in reference to FIGS. 7 and 8, which depict example operations for pulsed power drilling via cable-delivered power through insulated coiled tubing.

FIGS. 7 and 8 are flowcharts depicting example operations for pulsed power drilling, according to some implementations. Operations of flowcharts 700 and 800 of FIGS. 7 and 8 continue between each other through transition point A. Operations of the flowcharts 700 and 800 of FIGS. 7 and 8 may be performed by software, firmware, hardware, or a combination thereof. Operations of the flowcharts 700 and 800 are described in reference to the example pulsed power drilling system 100 of FIG. 1, but the operations may be applicable to any pulse power system (e.g., fracturing). Other systems and components may also be used to perform the operations now described. The operations of the flowchart 700 start at block 702.

At block 702, power from a power supply at the surface of the wellbore is delivered to a pulsed power drilling assembly downhole via a cable housed an insulated coiled tubing string running from the surface to the pulsed power drilling assembly. For example, with reference to FIG. 1, the power may be delivered from the power supply 180 at the surface 104 and down the wellbore 106 via the cable 116. The cable 116 may be positioned within the insulated coiled tubing 102.

As noted above in the discussion of FIG. 1, in pulsed power drilling, a substantial amount of heat is generated at the BHA 150. Pulsed power drilling is unique and quite different from conventional drilling methods like motor driven or drill pipe driven drill bits. In pulsed power drilling, high energy electrical pulses are forced into the rock to internally explode the formation. Transformation of medium voltage DC power into energy packed high voltage pulses produces kilowatts of heat loss in a relatively short span. It is important to limit the temperature rise in the pulse power section so that the electronic components do not thermally fail or become less reliable. Insulating the inside or outside of the CT is one of the better techniques for limiting the temperature rise in the drilling fluid as the drilling fluid moves downhole toward the BHA.

The oil-based drilling mud (OBM) used in this type of tool has multiple functions and one of them is to carry the heat generated in the pulsed power electronics away from the BHA. To achieve maximum heat transfer at the BHA, the mud temperature should be low (that is, there should be a significant heat differential between the temperature of the drilling fluid 110 and pulsed power electronics). It, therefore, becomes important to ensure the well environment does not heat the drilling fluid through the coiled tubing. Insulation therefore is applied to the coiled tubing. The non-abrasive and lubricating nature of the OBM used in pulsed power drilling puts less of a demand on the hardness of the insulating material. In addition, high thermal resistivity material may be used to reduce coating thickness, thus making the process more cost effective At block 704, the received power from the cable is filtered at the input filter. For example, with reference to FIG. 1, the power received by the cable 116 may be filtered at the input filter 120. The input filter 120 may condition the received power prior to being input into the boost charger 125.

At block 706, the received and filtered power has its voltage boosted at the boost charger. For example, with reference to FIG. 1, the boost charger 125 may boost the voltage of power output from the input filter from 3 kV to 16 kV.

At block 708, the boosted voltage output from the boost charger is used to charge a primary capacitor. For example, with reference to FIG. 1, the boost charger 125 may be used to charge the primary capacitor(s) 136. From block 708, operations continue at block 710 and transition point A, which continues at transition point A of the flowchart 800.

At block 710, a determination is made of whether a discharge criteria is satisfied. For example, with reference to FIG. 1, the pulse power controller 130 may determine whether one or more discharge criteria is satisfied. For example, the discharge criteria may be a criteria that a defined amount of energy has been stored in the primary capacitor(s) 136. An example may be that the primary capacitor(s) 136 are fully charged, more than a defined percent (e.g., 99%, 95%, 90%, 50%, etc.), etc. Another example criteria may be that a bottom of the drill string is in contact with a bottom of the wellbore. For example, the criteria may be that at least a minimum amount of surface area of the bottom of the drill string in in contact with a bottom of the wellbore. Another example criteria may be that a defined amount of time has elapsed since a prior pulsing of the electrical discharge. This defined amount of time may help ensure that the bottom of the drill string is in contact with a bottom of the wellbore prior to pulsing of the electrical discharge.

At block 712, an electrical discharge is pulsed into rock of the subsurface formation based on discharging of the primary capacitor. For example, with reference to FIG. 1, in response to the discharge criteria being satisfied, the pulse power controller 130 may cause the primary capacitor(s) 136 to release the stored energy from the primary capacitor(s) 136 through the electrodes 144—resulting in the pulsed of electrical discharge into the surrounding subsurface formation. This pulsing of the electrical discharge may continue to occur periodically in response to the discharge criteria being satisfied. Accordingly, operations of the flowchart 700 may return to block 710 to determine whether a discharge criteria is subsequently satisfied.

Operations of the flowchart 800 are now described. From transition point A, operations continue at block 802.

At block 802, a determination is made of whether a defined amount of current has been stored in the primary capacitors. For example, with reference to FIG. 1, the pulse power controller 130 may make this determination whether a defined amount of charge is stored in the primary capacitor(s) 136. For example, the defined amount of charge may be that the primary capacitor(s) 136 are fully charged, more than a defined percent (e.g., 99%, 95%, 90%, 50%, etc.), etc. If the defined amount of charge has not been stored, operations of the flowchart 800 remain at block 802 to again determine whether a defined amount of charge has been stored. If the defined amount of charge has been stored, operations of the flowchart 800 continue at block 804.

At block 804, the switch is opened to prevent storing charge in the primary capacitor. For example, with reference to FIG. 1, one or more switches in the switch bank 134 may be opened to prevent flow of charge for storage in the primary capacitor(s) 136.

At block 806, a determination is made of whether a pulse of electrical discharge has occurred. For example, with reference to FIG. 1, the pulse power controller 130 may make this determination because the pulse power controller 130 may control when a pulse of the electrical discharge happens. That is, the pulse power controller 130 may enable the releasing of the stored energy from the primary capacitor(s) 136 through the electrodes 144—resulting in the pulse of electrical discharge into the surrounding subsurface formation. If the pulse of electrical discharge has not occurred, operations remain at block 806 to continue to check. If the pulse of electrical discharge has occurred, operations continue at block 808.

At block 808, the switch is closed to recharge the primary capacitor from the power output from the boost charger. For example, with reference to FIG. 1, the pulse power controller 130 may close a switch positioned between the boost charger 125 and the primary capacitor(s) 136. This closed position would again allow the storing of charge in the primary capacitor(s) 136. Operations return to block 802, where a determination is made of whether the defined amount of charge has been stored.

The flowcharts are provided to aid in understanding the illustrations and are not to be used to limit the scope of the claims. The flowcharts depict example operations that may vary within the scope of the claims. Additional operations may be performed; fewer operations may be performed; the operations may be performed in parallel; and the operations may be performed in a different order. For example, the operations depicted in blocks 1602-1610 may be performed at least partially in parallel or concurrently. It will be understood that each block of the flowchart illustrations and/or block diagrams, and combinations of blocks in the flowchart illustrations and/or block diagrams, may be implemented by program code. The program code may be provided to a processor of a general-purpose computer, special purpose computer, or other programmable machine or apparatus.

As will be appreciated, aspects of the disclosure may be implemented as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit,"

"module" or "system." The functionality presented as individual modules/units in the example illustrations may be organized differently in accordance with any one of platform (operating system and/or hardware), application ecosystem, interfaces, programmer preferences, programming language, administrator preferences, etc.

While the aspects of the disclosure are described with reference to various implementations and exploitations, it will be understood that these aspects are illustrative and that the scope of the claims is not limited to them. In general, techniques for pulsed power drilling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

EXAMPLE EMBODIMENTS

Example embodiments include the following:

Embodiment #1: A system comprising: a bottom hole assembly (BHA), the BHA including: at least one capacitor, the at least one capacitor configured to store electrical power; and at least one electrode electrically coupled to the at least one capacitor, the at least one electrode configured to receive the stored electrical power from the at least one capacitor and to periodically emit pulsed power discharges into a subsurface formation; and at least one thermally insulated coiled tubing connected to the BHA, the thermally insulated coiled tubing configured to carry drilling fluid to the BHA.

Embodiment #2: The system of Embodiment #1, wherein the at least one thermally insulated coiled tubing includes a length of coiled tubing with thermal insulation applied to an inside surface of the coiled tubing.

Embodiment #3: The system of Embodiment #2, wherein the system further includes a power supply installed at the surface of a wellbore, wherein the BHA and the at least one thermally insulated coiled tubing are installed in the wellbore, and wherein the at least one thermally insulated coiled tubing further includes an electrical cable housed within the at least one thermally insulated coiled tubing, the electrical cable electrically coupling the power supply to the BHA.

Embodiment #4: The system of Embodiment #3, wherein the power cable is integrated in the coiled tubing between the inside of the length of coiled tubing and the thermal insulation.

Embodiment #5: The system of Embodiment #3, wherein the power supply is a direct current (DC) power supply, and wherein the BHA further includes a boost charger connected to the DC power supply, the boost charger configured to increase a voltage received from the DC power supply at least partially in parallel with storing power received from the DC power supply in the at least one capacitor.

Embodiment #6: The system of any one of Embodiments #2-5, wherein the at least one thermally insulated coiled tubing further includes a protective layer covering an inside surface of the thermal insulation.

Embodiment #7: The system of Embodiment #1, wherein the at least one thermally insulated coiled tubing includes a length of coiled tubing with thermal insulation applied to the outside of the length of coiled tubing.

Embodiment #8: The system of Embodiment #7, wherein the system further includes a power supply installed at the surface of a wellbore, wherein the BHA and the at least one thermally insulated coiled tubing are installed in the wellbore, and wherein the at least one thermally insulated coiled tubing further includes an electrical cable housed within the at least one thermally insulated coiled tubing, the electrical cable electrically coupling the power supply to the BHA.

Embodiment #9: The system of Embodiment #7, wherein the power supply is a direct current (DC) power supply, and wherein the BHA further includes a boost charger connected to the DC power supply, the boost charger configured to increase a voltage received from the DC power supply at least partially in parallel with storing power received from the DC power supply in the at least one capacitor.

Embodiment #10: The system of any one of Embodiments #8 and 9, wherein the at least one thermally insulated coiled tubing further includes a protective layer covering an outside surface of the thermal insulation.

Embodiment #11: The system of any one of Embodiments #1-10, wherein the at least one thermally insulated coiled tubing includes at least one of a fiber optic cable or a coaxial communication cable.

Embodiment #12: A pulsed power drilling apparatus configured to extend a wellbore formed in a subsurface formation, the pulsed power drilling apparatus comprising: a bottom hole assembly (BHA), the BHA including: at least one capacitor, the at least one capacitor configured to store electrical power; and at least one electrode electrically coupled to the at least one capacitor, the at least one electrode configured to receive the stored electrical power from the at least one capacitor and to periodically emit pulsed power discharges into a subsurface formation; and a thermally insulated coiled tubing, the thermally insulated coiled tubing including an electrical cable extending through the thermally insulated coiled tubing to the BHA, wherein the electrical cable is electrically coupled to the BHA and is configured to carry electrical power from a power supply at a surface of the wellbore to the BHA.

Embodiment #13: The pulsed power drilling apparatus of Embodiment #12, wherein the thermally insulated coiled tubing is configured to convey a drilling fluid from the surface of the wellbore downhole to the BHA.

Embodiment #14: The pulsed power drilling apparatus of Embodiment #12, wherein the at least one thermally insulated coiled tubing includes a length of coiled tubing with thermal insulation applied to a surface of the coiled tubing.

Embodiment #15: The pulsed power drilling apparatus of Embodiment #14, wherein the at least one thermally insulated coiled tubing further includes a protective layer covering a surface of the thermal insulation.

Embodiment #16: A method comprising: placing a cable inside a length of coiled tubing, the cable extending approximately the length of the coiled tubing; and applying insulation to a surface of the length of coiled tubing.

Embodiment #17: The method of Embodiment #16, wherein applying insulation to a surface of the length of coiled tubing includes covering the cable with insulation.

Embodiment #18: The method of Embodiment #16, wherein the method further comprises applying a protective layer over a surface of the thermal insulation.

Embodiment #19: The method of Embodiment #16, wherein applying insulation to a surface of the length of coiled tubing includes running a tractor down the length of the coiled tubing, wherein the tractor applies the insulation.

Embodiment #20: The method of Embodiment #16, wherein applying insulation to a surface of the length of coiled tubing includes running a tractor down the length of the coiled tubing, wherein the tractor applies and dries the insulation.

What is claimed is:

1. A system comprising:

a bottom hole assembly (BHA), the BHA including:

at least one primary capacitor, the at least one primary capacitor configured to store electrical power; and at least one electrode electrically coupled through a switch to the at least one primary capacitor, the at least one electrode configured to receive the stored electrical power as pulsed power discharges from the at least one primary capacitor and to periodically emit the pulsed power discharges into a subsurface formation; and at least one thermally insulated coiled tubing connected to the BHA, the thermally insulated coiled tubing configured to carry drilling fluid to the BHA, wherein the thermally insulated coiled tubing includes one or more layers of a coating, wherein each coating layer covers a surface of the coiled tubing and extends substantially an entire length of the thermally insulated coiled tubing, each coating layer, when cured, including at least 50 percent Hydro-NM-Oxide;

wherein the thermally insulated coiled tubing further includes a power cable attached to an inside surface of the thermally insulated coiled tubing, the power cable extending substantially the length of the thermally insulated coiled tubing and configured to electrically couple the at least one primary capacitor to an electrical power supply installed proximate the surface of a wellbore.

2. The system of claim 1, wherein each coating layer is applied to an inside surface of the coiled tubing and includes approximately 70 percent Hydro-NM-Oxide when cured.

3. The system of claim 2, wherein the system further includes a power supply, the power cable electrically coupling the power supply to the BHA.

4. The system of claim 3, wherein the power cable is integrated in the coiled tubing between the inside surface of the length of coiled tubing and the thermal insulation.

5. The system of claim 3, wherein the power supply is a direct current (DC) power supply, and wherein the BHA further includes a boost charger connected through the power cable to the DC power supply, the boost charger configured to increase a voltage received from the DC power supply at least partially in parallel with storing power received from the DC power supply in the at least one primary capacitor.

6. The system of claim 2, wherein the at least one thermally insulated coiled tubing further includes a protective layer covering an inside surface of the thermal insulation.

7. The system of claim 1, wherein each coating layer is applied to the outside of the coiled tubing and includes approximately 70 percent Hydro-NM-Oxide when cured.

8. The system of claim 7, wherein the system further includes a power supply, the power cable electrically coupling the power supply to the BHA.

9. The system of claim 7, wherein the power supply is a direct current (DC) power supply, and wherein the BHA further includes a boost charger connected through the power cable to the DC power supply, the boost charger configured to increase a voltage received from the DC power supply at least partially in parallel with storing power received from the DC power supply in the at least one primary capacitor.

10. The system of claim 8, wherein the at least one thermally insulated coiled tubing further includes a protective layer covering an outside surface of the thermal insulation.

11. The system of claim 1, wherein the at least one thermally insulated coiled tubing includes at least one of a fiber optic cable or a coaxial communication cable.

12. A pulsed power drilling apparatus configured to extend a wellbore formed in a subsurface formation, the pulsed power drilling apparatus comprising:

a bottom hole assembly (BHA), the BHA including:

at least one primary capacitor, the at least one primary capacitor configured to store electrical power; and at least one electrode electrically coupled through a switch to the at least one primary capacitor, the at least one electrode configured to receive the stored electrical power as pulsed power discharges from the at least one primary capacitor and to periodically emit the pulsed power discharges into a subsurface formation; and a thermally insulated coiled tubing, the thermally insulated coiled tubing including an electrical cable extending through the thermally insulated coiled tubing to the BHA, wherein the electrical cable is electrically coupled to the BHA and is configured to carry electrical power from a power supply at a surface of the wellbore to the at least one primary capacitor, wherein the thermally insulated coiled tubing includes thermal insulation, the thermal insulation including one or more layers of a coating, wherein each layer of coating covers a surface of the thermally insulated coiled tubing and extends substantially an entire length of the thermally insulated coiled tubing, each coating layer, when cured, including at least 50 percent Hydro-NM-Oxide.

13. The pulsed power drilling apparatus of claim 12, wherein the thermal insulation includes enough layers of the coating to ensure that a chilled drilling fluid conveyed from the surface of the wellbore downhole to the BHA arrives at the BHA without a significant rise in temperature.

14. The pulsed power drilling apparatus of claim 12, wherein one or more layers of the coating are applied to an inside surface of the coiled tubing, and wherein each coating layer, when cured, includes approximately 70 percent Hydro-NM-Oxide.

15. The pulsed power drilling apparatus of claim 14, wherein the at least one thermally insulated coiled tubing further includes a protective layer covering a surface of the thermal insulation.

16. A method comprising:

attaching a cable to an inside surface of a coiled tubing, the cable extending approximately an entire length of the coiled tubing, the cable capable of carrying electrical power from a borehole opening to a pulsed power drilling apparatus in a bottom hole assembly (BHA) at the bottom of the borehole; and applying insulation to a surface of substantially the entire length of coiled tubing, wherein applying the insulation includes applying one or more layers of a coating, the coating, when cured, including at least 50 percent Hydro-NM-Oxide.

17. The method of claim 16, wherein applying insulation to a surface of substantially the entire length of coiled tubing includes covering the cable with one of the one or more layers of the coating, and wherein each coating layer, when cured, includes approximately 70 percent Hydro-NM-Oxide.

18. The method of claim 16, wherein the method further comprises applying a protective layer over a surface of the insulation.

19. The method of claim 16, wherein applying insulation to a surface of substantially the entire length of coiled tubing includes running a tractor down substantially the entire length of the coiled tubing, wherein the tractor applies the insulation.

20. The method of claim 16, wherein applying insulation to a surface of substantially the entire length of coiled tubing includes running a tractor down substantially the entire length of the coiled tubing, wherein the tractor applies and dries the insulation.

* * * * *